US010100482B2

(12) United States Patent
Larsen et al.

(10) Patent No.: US 10,100,482 B2
(45) Date of Patent: Oct. 16, 2018

(54) METHOD OF INSTALLING AN OFFSHORE FOUNDATION AND TEMPLATE FOR USE IN INSTALLING AN OFFSHORE FOUNDATION

(71) Applicant: MHI Vestas Offshore Wind A/S, Aarhus N (DK)

(72) Inventors: Gerner Larsen, Hinnerup (DK); Niels Christian Olsen, Lye (NO)

(73) Assignee: MHI Vestas Offshore Wind A/S, Aarhus N (DK)

( * ) Notice: Subject to any disclaimer, the term of this patent is extended or adjusted under 35 U.S.C. 154(b) by 0 days.

(21) Appl. No.: 14/915,317

(22) PCT Filed: Aug. 28, 2014

(86) PCT No.: PCT/DK2014/000043
§ 371 (c)(1),
(2) Date: Feb. 29, 2016

(87) PCT Pub. No.: WO2015/028020
PCT Pub. Date: Mar. 5, 2015

(65) Prior Publication Data

US 2016/0208453 A1 Jul. 21, 2016

(30) Foreign Application Priority Data

Aug. 28, 2013 (DK) ..... 2013 70470

(51) Int. Cl.
*E02D 7/00* (2006.01)
*E02D 13/04* (2006.01)
(Continued)

(52) U.S. Cl.
CPC ..... *E02D 7/00* (2013.01); *E02B 17/02* (2013.01); *E02D 7/02* (2013.01); *E02D 13/04* (2013.01);
(Continued)

(58) Field of Classification Search
CPC combination set(s) only.
See application file for complete search history.

(56) References Cited

U.S. PATENT DOCUMENTS 4,733,993 A * 3/1988 Andreasson ..... B63B 21/26 114/296
5,899,639 A * 5/1999 Simmons ..... E02B 17/027 405/195.1
(Continued)

FOREIGN PATENT DOCUMENTS

CN 200971492 Y 11/2007
CN 201779093 U 3/2011
(Continued)

OTHER PUBLICATIONS

Danish Patent and Trademark Office, Search Report issued in Application No. PA 2013 70470 dated Mar. 13, 2014.
(Continued)

*Primary Examiner* — Kyle Armstrong
(74) *Attorney, Agent, or Firm* — Wood Herron & Evans LLP

(57) ABSTRACT

The present invention provides a method of installing a foundation for an offshore wind turbine and a template for use herein. In illustrative embodiments, the template is releasably anchored in a seafloor and the template is leveled before installing a pile. In a method according to some illustrative embodiments herein, a template may be provided, the template comprising at least one hollow guiding element for receiving the pile, at least one suction bucket, a frame body to which the at least one hollow guiding element and the at least one suction bucket are coupled, and controlling means configured to supply a pressure to the at least one suction bucket. The method may comprise disposing the template on the seafloor, supplying a negative pressure to the at least one suction bucket for driving the suction bucket in
(Continued)

to the seafloor, and controlling the negative pressure supplied to the at least one suction bucket to adjusting a penetration depth of the at least one suction bucket so as to level the frame relative to the seafloor.

29 Claims, 6 Drawing Sheets

(51) Int. Cl.

| | |
|---|---|
| ***E02D 27/42*** | (2006.01) |
| ***E02B 17/02*** | (2006.01) |
| ***E02D 7/02*** | (2006.01) |
| ***E02D 27/12*** | (2006.01) |
| ***E02D 27/16*** | (2006.01) |
| ***E02D 27/52*** | (2006.01) |
| *E02B 17/00* | (2006.01) |

(52) U.S. Cl.
CPC ..... *E02D 27/12* (2013.01); *E02D 27/16* (2013.01); *E02D 27/42* (2013.01); *E02D 27/525* (2013.01); *E02B 2017/0043* (2013.01); *E02B 2017/0091* (2013.01); *E02D 2220/00* (2013.01); *E02D 2600/10* (2013.01)

(56) References Cited

U.S. PATENT DOCUMENTS

| | | | | |
|---|---|---|---|---|
| 6,488,446 | B1 * | 12/2002 | Riemers | B63B 21/27 114/296 |
| 2013/0183101 | A1 * | 7/2013 | Vandenbulcke | E02D 13/04 405/204 |
| 2015/0023738 | A1 * | 1/2015 | Van Vessem | E02D 13/04 405/228 |
| 2015/0321732 | A1 * | 11/2015 | Major | B63B 21/50 405/200 |

FOREIGN PATENT DOCUMENTS

| | | | |
|---|---|---|---|
| CN | 202176267 | U | 3/2012 |
| CN | 102561285 | A | 7/2012 |
| EP | 2354321 | A1 | 8/2011 |
| EP | 2402511 | A1 | 1/2012 |
| GB | 2469190 | A | 10/2010 |
| JP | S6149029 | A | 3/1986 |
| JP | H11158886 | A | 6/1999 |
| JP | 2011144532 | A | 7/2011 |
| JP | 2012012930 | A | 1/2012 |
| WO | 8602966 | A1 | 5/1986 |
| WO | 2007115573 | A1 | 10/2007 |

OTHER PUBLICATIONS

European Patent Office, Inernational Search Report issued in International Application No. PCT/DK2014/000043 dated Dec. 3, 2014.
Japanese Patent Office, Office Action in JP2016-537137, dated Jul. 26, 2018.

* cited by examiner

METHOD OF INSTALLING AN OFFSHORE FOUNDATION AND TEMPLATE FOR USE IN INSTALLING AN OFFSHORE FOUNDATION

BACKGROUND

1. Field of the Invention

The present invention generally relates to a method of installing a foundation for an offshore wind turbine and a template for use herein.

2. Description of the related art

In an installation of offshore facilities, such as wind power installations, offshore platforms, submerged water-driven turbine installations and the like, foundations are often provided by a plurality of columns or piles driven into the seafloor. For example, a supporting structure of a wind power installation is often constituted by a cylindrical tower segment which may be coupled to a foundation in the ground. Independent of the kind of offshore facility under consideration, the stability of an offshore facility relies heavily on the support provided by the foundation. Foundations for offshore facilities, such as for wind power installations, are planned and constructed based on thorough analyses of water depths at the installation site and soil conditions of the seafloor at the installation site. In the case of wind power installations, further issues are to be considered, such as turbine specifications including nacelle weight, revolving speeds and more. It is therefore easy to see that planning and constructing an offshore foundation is a complex task where any failure has to be excluded for not posing a risk on the stability of the foundation.

In general, two types of foundations are used, gravity based foundation and jacket foundation. A conventional gravity based foundation includes a concrete cylindrical/conical support structure which is held in place by its own weight. The jacket foundation is a steel structure with typically four legs connected to each other with braces. Commonly, the legs are grouted to piles which are driven into the sea soil. In comparison with gravity based foundations, jacket foundations are easily transported to the installation site.

Further, gravity based foundation have mostly been used for smaller wind turbines in shallow near-shore projects with rocky sea floors. For larger turbines and deeper waters in general jacket foundations are preferred over gravity based foundation. For assuring stability, installation of piles in a seafloor is to be carefully planned and the piles are installed in accordance with a predetermined installation scheme. Herein, reliability of the foundation depends, besides the quality of the predetermined installation scheme, on the accurate realization of the predetermined installation scheme and deviations may result in a structurally weakened foundation such that accurate alignment of piles is of great importance. Particularly, a relative location of a second pile relative to a first and an orientation of the piles relative to a vertical reference orientation are important parameters based on which the stability of a foundation is determined. It is with regard to these parameters that alignment is to be achieved as misalignment may not allow safe carrying of loads that are imposed on the foundation.

During installation of piles, alignment is conventionally achieved by means of a template according to which a geometric pattern of piles may be installed in a seafloor. However, due to possible unevenness of the seafloor at the installation site, misalignment of piles may be caused by the template adopting a leveling position deviating from a reference leveling position, usually a horizontal level.

Document EP 2354 321 A1 shows a framed template for providing an offshore foundation being positioned by a jack-up platform. Herein, the framed template is lowered along spud poles towards the seafloor and piles are driven into the seafloor through sleeve guide members of the template. However, a fast installation of piles is not possible as the jack-up platform is to be installed at the installation site requiring the spud poles to be fixed to the, seafloor. Furthermore, particularly at great depths and rough sea conditions, usage of the jack-up platform may not be possible, while an accuracy in the orientation of the framed template depends on the orientation of the spud poles such that any misalignment of the spud poles causes the framed template to be misaligned.

Document GB 2469190 A shows a submerged platform with a drilling machine and telescopic legs for adjusting the platform to a horizontal position such that a column or pile may be anchored to the seafloor at a predetermined position. However, the platform may be subjected to displacement relative to the seafloor such that misalignment of the platform relative to a predetermined installation site may be caused.

Document CN 200971492 shows a method for installing an undersea drilling base plate on the seabed.

Therefore, it is an object of the present invention to ensure accurate alignment of piles when installing an offshore foundation.

SUMMARY OF THE INVENTION

In an aspect of the present invention, a method of installing a foundation for an offshore wind turbine is provided. In an illustrative embodiment herein, the method may comprise providing a template with at least one hollow guiding element configured to receive a pile, at least one suction bucket and a frame body to which the at least one hollow guiding element and the at least one suction bucket are coupled. The method may further comprise disposing the template on the seafloor, supplying a negative pressure to the at least one suction bucket for driving the suction bucket in to the seafloor, and controlling the negative pressure supplied to the at least one suction bucket to adjusting a penetration depth of the at least one suction bucket so as to level the frame body relative to the seafloor. Furthermore, the method comprises disposing a pile in the hollow guiding element for installing the pile in the sea floor.

In this way, the template may be releasably anchored in a fixed position in the seafloor, while the template may be leveled by adjusting a penetration depth of the at least one suction bucket, such that accurate alignment is ensured.

In a further illustrative embodiment herein, the method may further comprise determining an inclination of the frame body relative to a predetermined reference level of the frame body and adjusting the negative pressure supplied to at least one suction bucket. Therefore, a controlled penetration of at least one suction bucket may be performed such that a more accurate alignment may be achieved.

In a further illustrative embodiment herein, the method may further comprise determining the penetration depth for the at least one suction bucket so as to level the frame body. In this way, a very accurate leveling of the frame may be easily and reliably achieved, independent of any specific condition of the seafloor the template is exposed to.

In a further illustrative embodiment herein, the method may further comprise controlling the negative pressure in dependence on the determined penetration depth. In this way, direct and fast leveling may be achieved, while reliably anchoring the template in the sea, floor.

In a further illustrative embodiment herein, the controlling of the negative pressure may comprise successively sensing an inclination of the frame body and adjusting the negative pressure supplied to the at least one suction bucket in dependence on the sensed inclination. In this way, a feedback-coupled controlling may be implemented.

In a further illustrative embodiment herein, a plurality of suction buckets may be provided and the method may further comprise coupling each suction bucket to an individual pump system. In this way, a reliable anchoring and leveling of the template may be achieved.

In a further illustrative embodiment herein, a plurality of suction buckets is provided and the method may further comprise coupling the plurality of suction buckets to a pump system having a single pump. In this way, anchoring and leveling may be achieved by means of a simple arrangement of a pump system with a single pump.

In a further illustrative embodiment herein, the pump system may be configured to supply negative pressure to each suction bucket individually. In this way, a reliable anchoring and leveling of the template may be achieved in terms of a single pump.

In a further illustrative embodiment herein, controlling the negative pressure may comprise controlling a valve element of each suction bucket so as to control the negative pressure supplied to each suction bucket individually, wherein the pump is coupled to the valve element. In this way, a plurality of suction buckets may be reliably controlled by means of a single pump.

In a further illustrative embodiment herein, controlling the negative pressure may comprise controlling at least one of an amount and flow of water being pumped out of the at least one suction bucket. In this way, a predetermined penetration depth of the at least one suction bucket in the seafloor may be easily adjusted.

In another aspect of the present invention, a template for use in installing an off-shore foundation is provided. In an illustrative embodiment herein, the template comprises at least one hollow guiding element for receiving the pile, at least one suction bucket, and a frame body to which the at least one hollow guiding element and the at least one suction bucket are coupled. Furthermore, the template comprises controlling means configured to supply a pressure to the at least one suction bucket.

In this way, a template is provided which allows rapid and releasably anchoring in a seafloor.

In a further illustrative embodiment herein, the template may further comprise a first pressure sensing device and/or a second pressure sensing device, the first pressure sensing device being coupled to one of the at least one suction buckets and configured to sense a pressure within the suction bucket, and the second pressure sensing device being configured to sense an ambient water pressure at a predefined position at the template. In this way, an inclination and/or a penetration depth may be easily determined.

In a further illustrative embodiment herein, the frame body of the template may be formed by frame elements being coupled together such that the frame body is of a polygonal shape. In this way, a template having an advantageous shape for implementing an installation of piles in accordance a predetermined pattern may be provided.

In a further illustrative embodiment herein, the template may comprise at least three suction buckets, each of which being mechanically coupled to one frame element. In this way, a reliable anchoring and leveling of the template may be rapidly achieved.

BRIEF DESCRIPTION OF THE DRAWINGS

The invention will hereinafter be described with reference to the accompanying figures, in which.

DETAILED DESCRIPTION

Figure 1A:
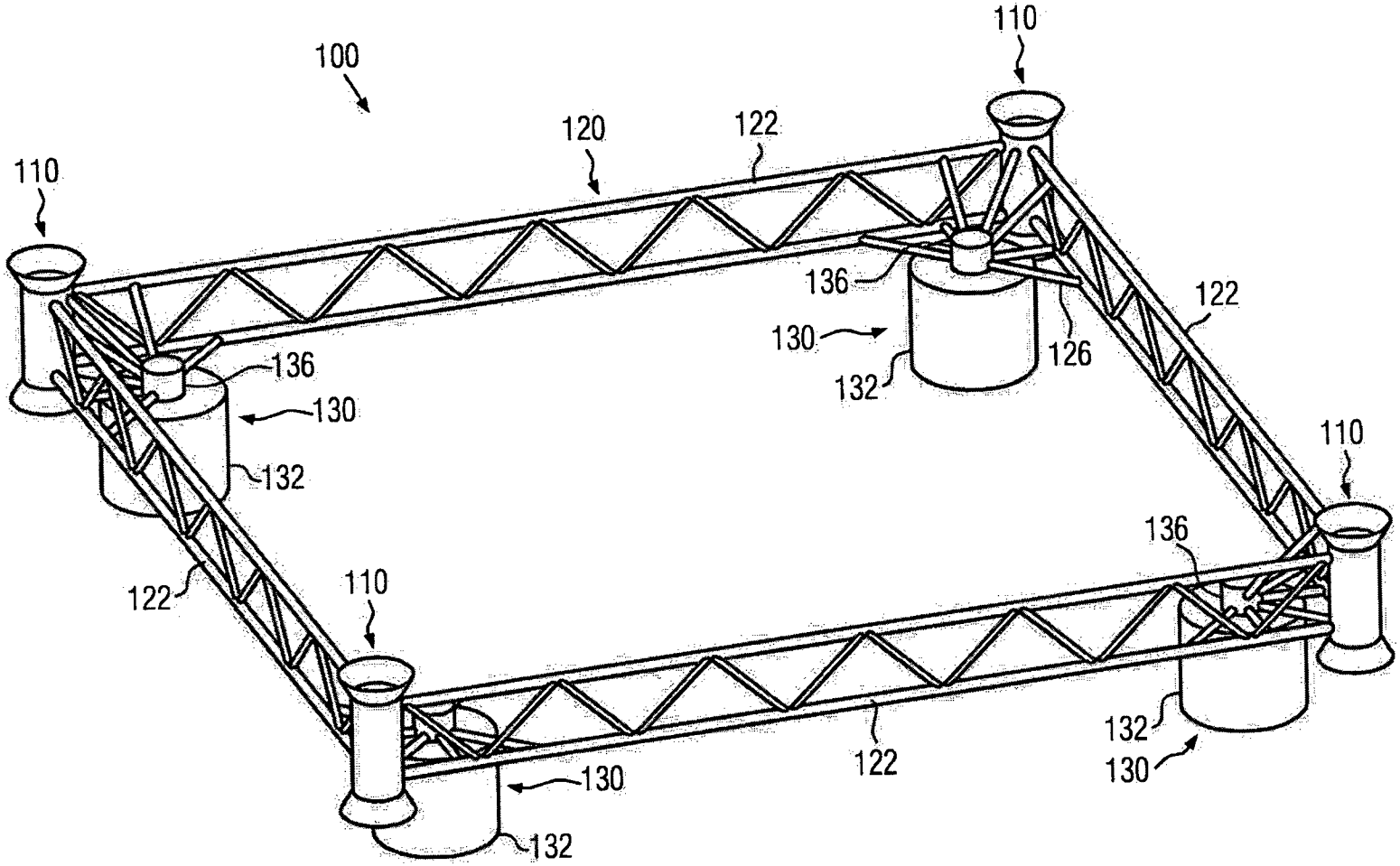
FIG. 1*a* schematically illustrates, in a perspective view, a template in accordance with an illustrative embodiment of the present invention.

With regard to FIGS. 1*a,* 1*b* and 1*c,* a template 100 in accordance with an illustrative embodiment of the present invention, will be described. The template 100 as shown in FIG. 1*a* is formed by a frame body 120 of a substantially quadrangular shape. The frame body 120 is provided by frame elements 122 which are arranged in accordance with sides of a quadrangular. The frame elements 122 are coupled to hollow guiding elements 110 disposed at corners of the quadrangular frame body 120. The frame elements 122 may be configured to locate the hollow guiding elements 110 at predetermined fixed positions relative to each other. Although the hollow guiding elements 110 are illustrated as being disposed at the corners of the frame body 120 adjoining adjacent frame elements 122, no limitation of the present invention is intended. Alternatively, the hollow guiding elements 110 may, for example, be mounted to the frame elements 122 at different positions along the frame elements 122. In a special example herein, each hollow guiding element 110 may be disposed at a center of a respective frame element 122.

The person skilled in the art will appreciate that any other appropriate geometric configuration may be considered for implementing a frame body, such as a triangular shape or, generally, a polygonal shape, having at least one hollow guiding element 110 attached thereto.

As illustrated in FIG. 1*a,* the frame elements 122 are formed by two parallel beams having crossbeam elements for reinforcing each frame element 122. However, this does not pose any limitation to the present invention, and the frame elements may be implemented by one or more than two beams representing a side of a polygonal geometric figure, with or without reinforcing crossbeam elements.

As shown in FIG. 1*a,* the template 100 further comprises four suction buckets 130 disposed at each corner of the template 100 within an area enclosed by the frame body 120 such that each suction bucket 130 opposes one of the hollow guiding elements 110. Although FIG. 1*a* explicitly illustrates four suction buckets 130, the person skilled in the art will appreciate that alternatively any other number of suction buckets, in general at least one suction bucket, may be provided. For example, two suction buckets 130 may be coupled to the frame body 120 at opposing positions. In another alternative example, three suction buckets may be coupled to the frame body 120. The person skilled in the art will appreciate that the suction buckets may be alternatively located along the frame elements 122 at positions away from the corners, such as close to a center of each frame element 122, i.e. in the middle between two hollow guiding elements 110 along a frame element 122.

Each suction bucket 130 is substantially provided by a cylindrical bucket 132 with an opening at one side (lower side in FIG. 1*a*) having a top element 136 fixed to a top side of the suction bucket 130. The top element 136 is connected to crossbeams 126 coupling the suction bucket 130 with at least one of the hollow guiding element 110 and at least one frame element 122,such as e.g. two frame elements 122, as illustrated in FIG. 1*a*. Alternatively, the bucket 132 may be directly coupled to the hollow guiding element 110 or the frame elements 122 for coupling the suction bucket 130 to the frame body 120.

Additionally or alternatively, the top element 136 of each suction bucket 130 may be configured for coupling with a pump system. In some special illustrative examples herein, the top element 136 may comprise a valve element (not illustrated) for coupling the suction bucket 130 to a hose of a pump system (not illustrated). In accordance with a special illustrative example, the valve element may represent a controlling means for supplying pressure. In general, any known device configured to provide a controlling operation when supplying pressure to a suction bucket may be used such that a pressure supply to the suction bucket may be controlled and a predetermined pressure may be adjusted. Therefore, alternatively, the suction buckets may be coupled to a pressure reservoir by some coupling means, such as a hose or the like, and some controlling means may be represented, for example, by a valve element of the reservoir or any other means suitable for controlling release of pressure from the pressure reservoir and/or transmission of pressure from the pressure reservoir to the suction buckets.

In some illustrative examples, the top element 136 may be provided with a pressure-sensing device for sensing at least one of a pressure within the bucket 132 and a pressure outside of the bucket, i.e. the surrounding water pressure. The person skilled in the art will appreciate that in comparing the pressure of surrounding water at the positions at least two suction buckets, an inclination of the frame body 120 may be determined. Alternatively, bubble-level-sensing devices may be provided at the suction buckets 130 and/or at or in the frame elements 120 and/or at or in the hollow guiding means 110. The person skilled in the art will appreciate, that general level sensing devices may be provided by mechanical means bases on bubble-level-sensing devices, level sensing devices based on a gyrometer, laser and the like. It is even possible to use air filled balloons attached at different positions to the frame and comparing a length of a rope attached to each balloon when letting the balloons float on the water surface. This does not pose any limitation on the present invention and the person skilled in the art will appreciate that other techniques may be used for achieving level sensing.

Figure 1B:
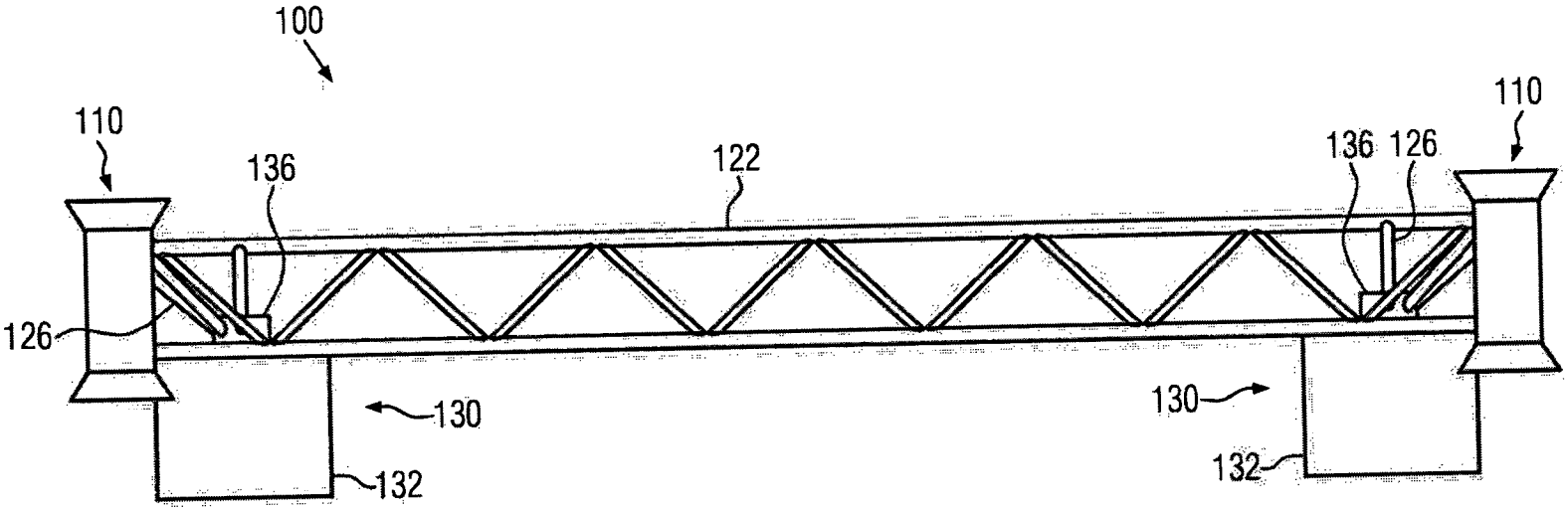
FIG. 1*b* schematically illustrates, in a side elevation view, the template as shown in FIG. 1*a;*

FIG. 1*b* illustrates a side elevation view of the template 100 along one of the frame elements 120. The suction buckets 130 are mounted to the frame elements 120 at a lower beam of the frame elements 120 such that the suction buckets 130 and particularly the buckets 132 having a lower open side, face towards a seafloor (not illustrated). A height difference between the lower side of the buckets 132 and a lower side of the hollow guiding elements 110 represents a maximum penetration depth for the suction buckets 130.

Figure 1C:
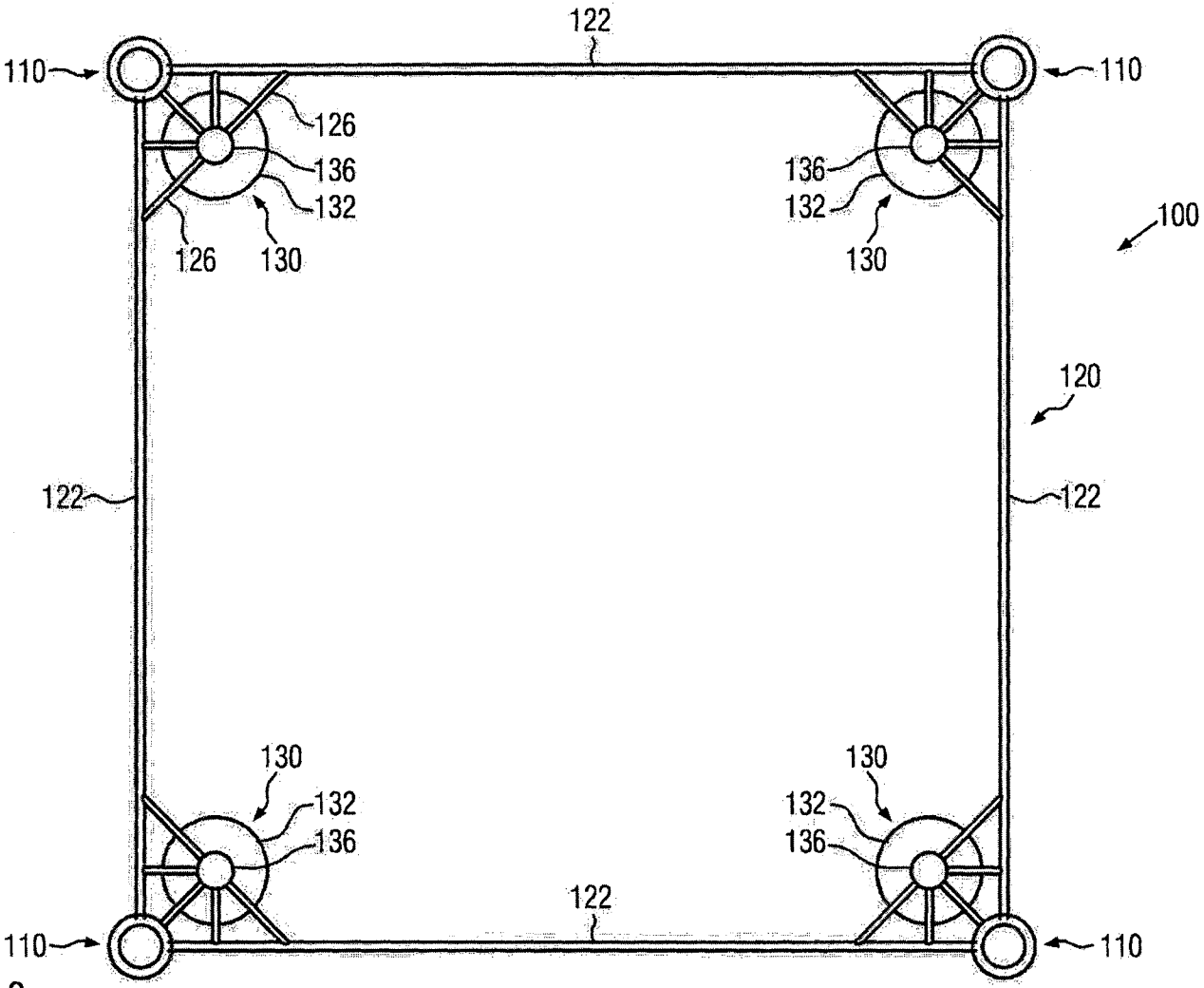
FIG. 1*c* schematically illustrates, in a top view, the template as shown in FIG. 1*a;*

FIG. 1*c* illustrates a top view of the template 100 showing a special illustrative example of the present invention as illustrated in FIG. 1*a*.

Figures 2, 3:
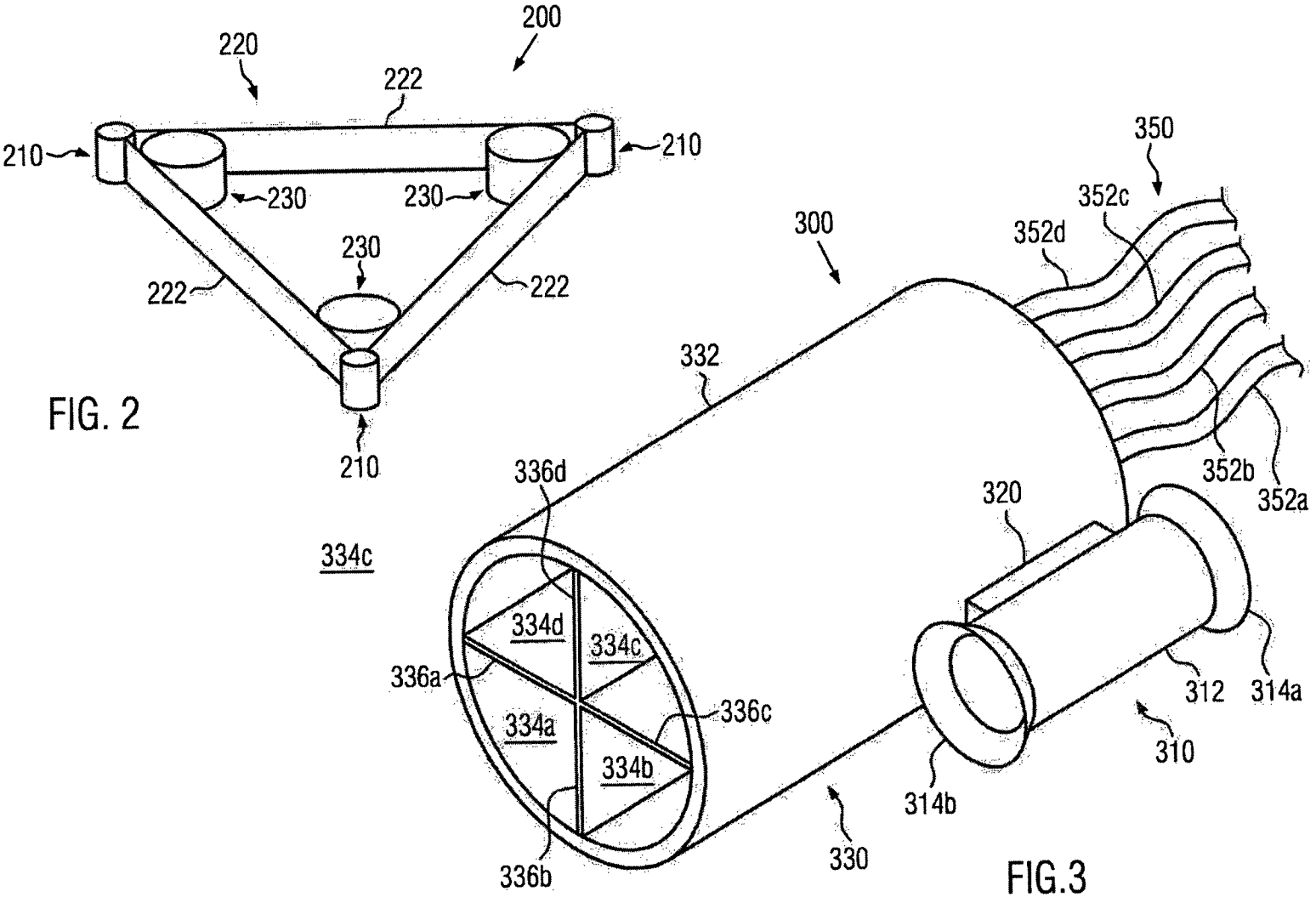
FIG. 2 schematically illustrates, in a perspective view, a template in accordance with an alternative embodiment of the present invention.
FIG. 3 schematically illustrates, in a perspective view, a template in accordance with another alternative embodiment of the present invention.

An alternative illustrative embodiment is schematically illustrated in FIG. 2 showing a template 200 with a triangularly shaped frame body 220 having hollow guiding elements 210 at each corner of the frame body 220. The frame body 220 is implemented by frame elements 222 to which the hollow guiding elements 210 are coupled. Furthermore, the template 200 comprises three suction buckets 230 each coupled to the frame body 220 opposing respective hollow guiding elements 210. The person skilled in the art will appreciate that a plane is defined in three dimensions by three distinct points, the embodiment illustrated in FIG. 2 allows a direct and easy alignment of the template 200 to a high accuracy.

It is noted that the hollow guiding elements 210 and/or the suction buckets 230 may be coupled to the frame body 220 such that a hollow guiding element 210 and/or a suction bucket 230 are each disposed along a single frame element 222, e.g. towards a center of a single frame element 222.

Though FIG. 2 illustrates three suction buckets, the person skilled in the art will appreciate that in only employing one suction bucket, alignment may be already achieved in tilting the template around an axis corresponding to the frame element opposite the suction bucket. Alternatively, in employing two suction buckets, tilting around two axes may be achieved, each axis corresponding to a frame element opposite a suction bucket. In this case, one or two suction buckets out of the three suction buckets illustrated in FIG. 2 may be replaced by a supporting element (not illustrated) such as a footing element resting on the sea floor.

A further alternative illustrative embodiment is depicted in FIG. 3 showing a template 300 having one hollow guiding element 310 and one suction bucket 330 coupled by a frame body given by a single frame element 320. The hollow guiding element 310 has a cylindrical sleeve element 312 and outwardly projecting flange portions 314*a* and 314*b* at respective sides of the cylindrical sleeve element 312. The person skilled in the art will appreciate that receipt of a pile may be facilitated by the flange portion 314*a*.

In the explicitly illustrated example, the suction bucket further comprises chambers 334*a*, 334*b*, 334*c*, 334*d*, the chambers being defined by wall elements 336*a*, 336*b*, 336*c*, 336*d*. The person skilled in the art will appreciate that a possible number of chambers may be one or more. A number of chambers greater than one allows, in addition to releasably anchoring, to tilt the template 300 relative to a vertical axis given by a longitudinal dimension of the template 300 extending through its center. Each of the chambers 334*a*, 334*b*, 334*c*, 334*d* may be coupled to a pump system 350 as represented by hoses 352*a*, 352*b*, 352*c*, 352*d*.

A further alternative of a template having one suction bucket may be obtained from the embodiment illustrated in FIG. 3 by replacing the frame element 320 by a longer frame element and coupling a supporting structure to the end of the longer frame element opposite the end at which the suction bucket is disposed. The hollow guiding element of this alternative may be coupled to the longer frame element along its extension. With regard to the suction bucket in this alternative embodiment, a one chambered suction bucket is preferred. Then, the person skilled in the art will understand, leveling may be obtained by driving the suction bucket into the sea floor, wherein with increasing penetration depth of the suction bucket a tilting towards the suction bucket is obtained. In this way, an inclination along the frame element where the end of the frame element supporting the suction bucket is higher than the opposite end may be balanced.

With regard to FIG. 4, an operation of the suction buckets will be described with regard to further illustrative embodiments of the present invention.

Figure 4:
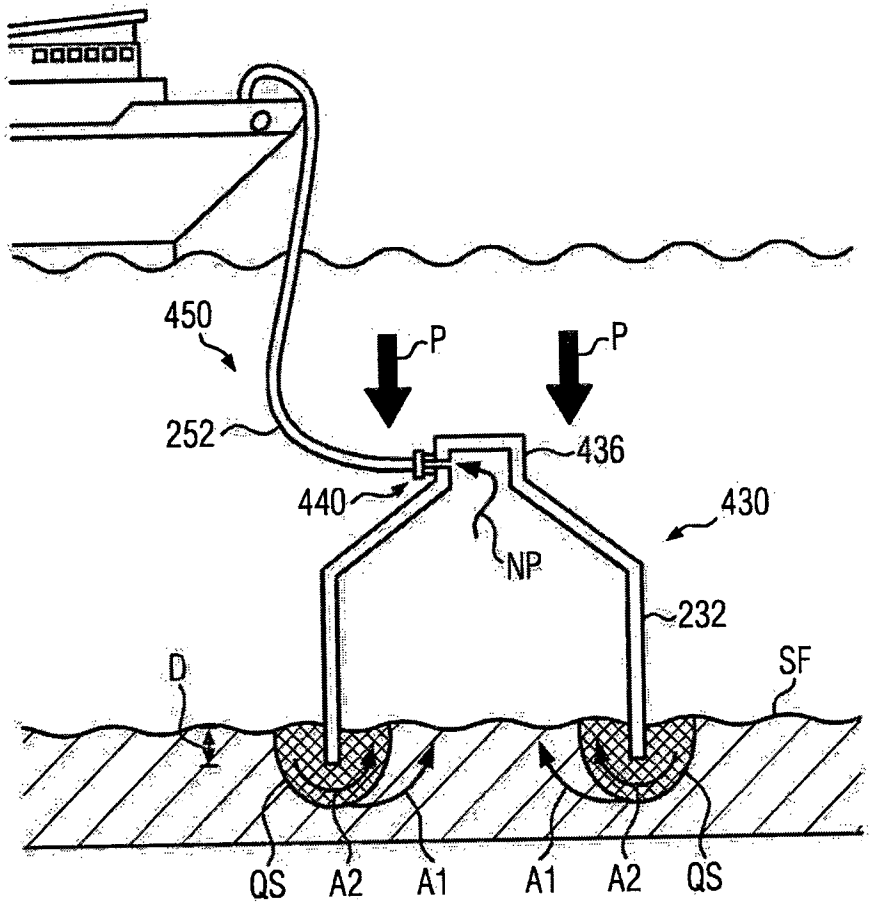
FIG. 4 schematically illustrates a mode of operating a suction bucket in accordance with some illustrative embodiments of the present invention.

FIG. 4 schematically illustrates a template by means of a single suction bucket 430 according to another illustrative embodiment of the present invention. For ease of illustration, the frame body (c.f. reference numerals 120 in FIG. 1*a*, 220 in FIG. 2, 320 in FIG. 3) and hollow guiding elements (c.f. reference numerals 110 in FIGS. 1*a*, 210 in FIG. 2, 310 in FIG. 3) of the template are not illustrated. If applicable, additional suction buckets may be provided, which are not illustrated in FIG. 4. Upon disposing the template, and particularly the suction bucket 430, on a seafloor SF, the suction bucket 430 is disposed on the seafloor SF with its open side facing towards the seafloor SF.

The suction bucket 430, as illustrated in FIG. 4, comprises a bucket 432 and a top element 436. The top element 436 has a valve element 440 which is configured for coupling to a pump system 450, which is schematically indicated by a hose 252 in FIG. 4. The pump system 450 may be located on a ship as illustrated in FIG. 4 or, alternatively, on an installation platform (not illustrated).

Upon supplying a negative pressure to the suction bucket 430, particularly by pumping out water from the interior of the suction bucket 430 by means of the pumping system 450 (indicated by an arrow NP in FIG. 2), a pressure difference relative to the pressure of the water column above the suction bucket acting on the suction bucket is created, as indicated by arrows P in FIG. 4. Upon pumping out the water from the suction bucket, a quicksand region QS is generated around the rim of the bucket 432 caused by water flowing into the bucket through sediment of the seafloor SF, indicated in FIG. 4 by arrows A1 and A2. Due to the quicksand region QS and the pressure difference P relative to the water pressure outside the suction bucket 430, the suction bucket 430 easily and rapidly penetrates the seafloor SF.

FIG. 4 illustrates the suction bucket 430 having penetrated into the seafloor. SF to a penetration depth D. When stopping the pumping of water out of the suction bucket 430, a strong anchoring of the suction bucket within the seafloor SF is provided, as, for pulling out the suction bucket, a high force is necessary in order to overcome the vacuum relative to the surrounding water pressure implemented by the amount of water pumped out from the suction bucket 430. The person skilled in the art will appreciate that in controlling the penetration depth D of the suction bucket 430, a leveling of the template (not illustrated) may be reliably achieved, while a strong anchoring of the suction bucket 430 to the seafloor is provided.

The suction bucket 430 may be released from the seafloor SF by pumping water into the suction bucket 430 (reversing the direction of the arrow NP in FIG. 4) which therefore pushes the suction bucket 430 out from its anchoring position in the seafloor SF. Therefore, the solid and reliable anchoring of the suction bucket may be easily released by pumping water into the suction bucket 430 and supplying a positive pressure to the suction bucket 430, respectively. Releasing of the suction bucket 430 may be further supported by additionally applying a lifting force to the suction bucket and/or the frame (not illustrated) concurrently with supplying the positive pressure and pumping water into the suction bucket 430, respectively. In an advantageous example herein, the positive pressure is supplied such that the horizontal alignment of the template is not altered as than the possibility of damages and/or misalignment of the installed pile(s) is prevented. Additionally or alternatively, a pulsed supply of positive pressure may be provided for facilitating a release of the template.

In accordance with an illustrative embodiment of the present invention, an operation of the suction bucket for releasably anchoring a template (c.f. 100 if FIG. 1*a*) may be performed for installing a pile by providing the template on the seafloor such that the one or more suction buckets (130 in FIG. 1*a*, 430 in FIG. 4) faces a seafloor (SF in FIG. 4) with the open side of the bucket.

In some illustrative embodiments, an inclination of the template relative to a desired horizontal level may be determined by inclination-sensing devices or level-sensing means implemented in the suction bucket 430 and/or at least one frame element (c.f. 120 in FIGS. 1*a* to 1*c*, 220 in FIG. 2, 320 in FIG. 3) and/or at least one hollow guiding element (c.f. 110 in FIGS. 1*a* to 1*c*, 210 in FIG. 2, 310 in FIG. 3) upon disposing the template on the seafloor. Based on a sensed-inclination of the template, a penetration depth (D in FIG. 4) of the at least one suction bucket (130 in FIG. 1*a*, 230 in FIG. 2, 330 in FIG. 3, 430 in FIG. 4) may be determined and/or at least one of an amount and flow (amount per time) of water out of the suction bucket 430 (indicated by arrow NP in FIG. 4) may be determined so as to level the template. Additionally or alternatively, a flow profile of water out of the at least one suction bucket 430 may be computed for the time interval beginning with supplying negative pressure to achieving leveling of the template by penetrating the suction bucket 430 into the seafloor to a predetermined penetration depth D.

Subsequently, a negative pressure may be supplied to the at least one suction bucket (130 in FIG. 1*a*, 230 in FIG. 2, 330 in FIG. 3, 430 in FIG. 4) by pumping out water from the interior of the suction bucket (130 in FIG. 1*a*, 230 in FIG. 2, 330 in FIG. 3, 430 in FIG. 4) so as to anchor the suction bucket in the seafloor. Upon supplying a negative pressure to the suction bucket, an inclination of the template may be sensed and/or the supply of negative pressure to the suction bucket may be controlled by controlling the amount and/or flow of water out from the interior of the suction bucket. For example, the negative pressure may be controlled by controlling a flow of water being pumped out, adjusting the flow such that a desired penetration depth is reached without ceasing the flow until leveling and/or anchoring is achieved. In some special illustrative examples herein, a pressure within the suction bucket (130 in FIG. 1*a*, 230 in FIG. 2, 330 in FIG. 3, 430 in FIG. 4) and/or a pressure of ambient water, i.e. water surrounding the template representing water outside the suction bucket at the level of the template, may be sensed and the flow of water pumped out of the suction bucket may be controlled in dependence on at least one of the sensed pressure inside of the suction bucket and the sensed pressure of the surrounding water. For example, a first pressure sensing device may be disposed such that a pressure within a suction bucket may be sensed and/or a second pressure sensing device may be coupled to the template such that an ambient water pressure may be sensed at a position close to the template, i.e. at the frame body and/or a hollow guiding element and/or a suction bucket. In some special illustrative example herein, the second pressure sensing device may be movable along the frame body such that pressure may be sensed at more than one position along the frame body. Alternatively, a plurality of first and/or second pressure sensing devices may be provided so as to sense pressure within more than one suction bucket and/or at more than one position. In sensing the ambient water pressure at more than one position along the template, an inclination of the template may be determined. The person skilled in the art will appreciate that in comparing the pressure of surrounding water for different suction buckets and/or at different positions at the template, an inclination of the template may be determined.

In some illustrative embodiments, as described herein, topography of the sea floor may be determined before installing a foundation. Sea floor topography may be obtained by available data bases or may be determined by direct observation via optical imaging equipment or other techniques such as sonar and the like. Leveling data may be determined based on the topography and an according operation of a pump system may be determined, i.e. a negative pressure control for at least one suction bucket of the template.

In some illustrative embodiments of the present invention, a plurality of suction buckets (130 in FIG. 1*a,* 230 in FIG. 2, 430 in FIG. 4) may be provided, wherein each suction bucket of the plurality of suction buckets is individually coupled to a pump system such that a supply of negative pressure to each suction bucket may be individually controlled.

In other illustrative embodiments, a plurality of suction buckets may be provided, wherein alternatively the plurality of suction buckets is coupled to a pump system having a single pump. In some special illustrative example herein, the pump system may be configured such that each of the plurality of suction buckets may be individually supplied by an appropriate negative pressure. In a specific example of the present invention, each suction bucket of the plurality of suction buckets may have a valve element such that the negative pressure supplied to each suction bucket may be individually controlled by appropriately controlling the valve element.

After having releasably anchored the template in the seafloor, at least one pile may be installed in the seafloor by driving the pile provided in or received by one of the hollow guiding elements into the seafloor.

Figure 5B:
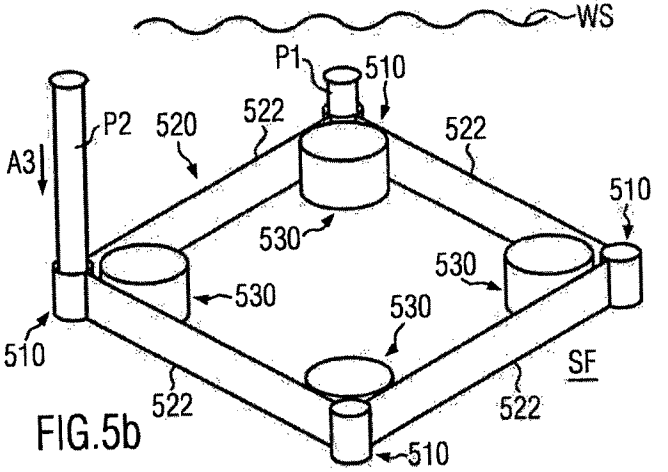
FIGS. 5*a* to 5*d* schematically illustrate a method of installing a jacket foundation in accordance with an illustrative embodiment of the present invention.
Figure 5D:
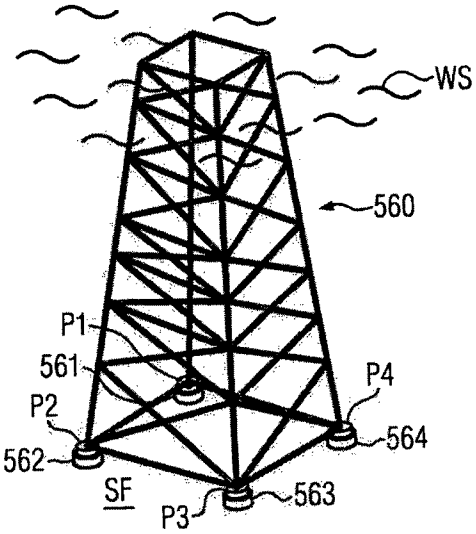
Figure 5A:
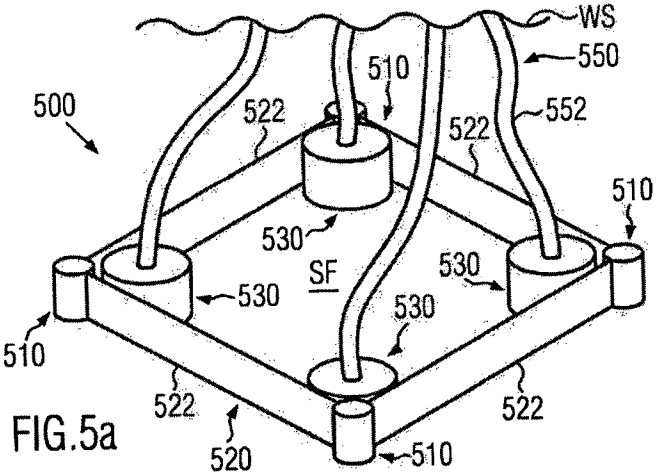

In the following, an illustrative embodiment for installing an offshore foundation will be described with regard to FIGS. 5*a,* 5*b,* 5*c* and 5*d.* FIG. 5*a* schematically illustrates a template 500 being disposed on a sea floor SF under the water surface WS. For sake of illustration, the template 500 corresponds to the template 100 as described with regard to FIGS. 1*a* to 1*c* above. However, this does not pose any limitation on the present invention, and a template in accordance with another embodiment as described above may be used instead.

The template 500 comprises hollow guiding elements 510 coupled to a frame body 520 and suction buckets 530 opposing the hollow guiding elements 510. The frame body 520 is formed by frame elements 522 to which the hollow guiding elements 510 and the suction buckets 530 are coupled.

The template 500 is coupled to a pump system 550 as it is schematically indicated in FIG. 5*a* by hoses 552, each of which coupling a suction bucket 530 to the pump system 550.

After having performed an anchoring and, if necessary, leveling operation as described above, piles are installed in the sea floor in accordance with the template. FIG. 5*b* shows the installation of piles at a stage in which a first pile P1 was installed in the sea floor SF and a second pile P2 is applied to a hollow guiding element 510 by inserting the pile P2 into the hollow guiding element 510 along a direction indicated by arrow A3.

Figure 5C:
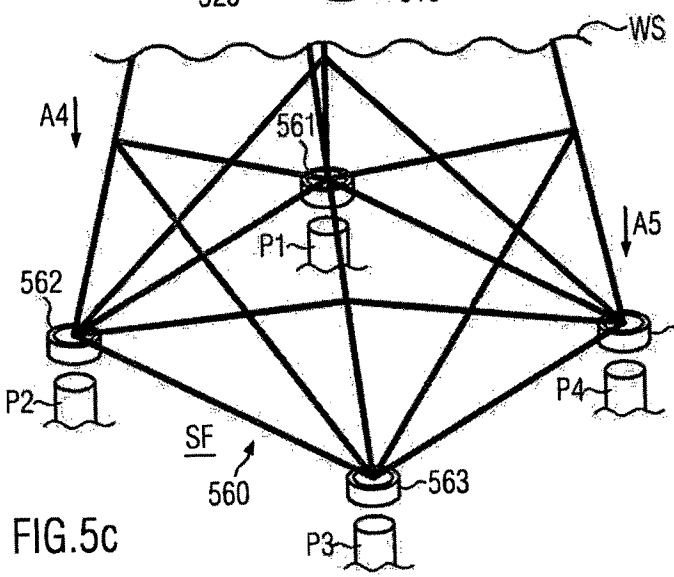

FIG. 5*c* illustrates the installation of a jacket foundation at a later stage in which piles P1, P2, P3, P4 are installed in the sea floor SF and the template is removed. As illustrated, a jacket foundation 560 is installed by coupling the jacket foundation with the piles P1, P2, P3, P4 as indicated by arrows A4, A5. The jacket foundation 560 has sleeve elements 561, 562, 563, 564 engaging respective piles P1, P2, P3, P4. Therefore, in coupling the sleeve elements 561, 562, 563, 564 with the respective piles P1, P2, P3, P4, the jacket foundation is reliably anchored to the sea floor SF as depicted in FIG. 5*d.*

In some illustrative example, the jacket foundation 560 may represent a foundation for an offshore wind power plant.

For larger turbines and deeper waters in general jacket foundations are preferred over gravity based foundations or monopole foundations. The present invention is in particular well-suited for improving jacket foundations. Jacket foundations typically comprise three or four legs and therefore need three or four piles.

When mounting a jacket on the piles, calm weather is necessary to obtain the required precision. Likewise in some prior art methods, putting the piles in the sea floor, also required calm weather, as e.g. the guidance of the piles were controlled from the water surface. With the present invention, it is possible to position the piles in almost any kind of weather, since the process solely happens below the water surface. This provides an enormous advantage over prior art, in that a number of foundations may be set in less time than before as only the mounting of the jackets on the foundations require calm weather. Further, obviously obtaining a precise individual distance between the piles is facilitated by being able to position the template on the sea floor as compared to having the guiding elements at the water surface.

The driving of the piles into the sea floor will typically be done such that only around 1 m of the piles is above the sea floor, for instance they may be driven down to more or less be flush with the upper surface of the hollow guiding elements. An extreme precision is desired, mainly as the height of the jackets may be large, e.g. 100 m, which is why only slight misalignments even on mm-scale may cause tilting on a larger level. Therefore, after the piles have been inserted into the sea floor, the exact upper surface height is measured, and, if required, additional rings are added to individual legs of the jacket before mounting on the piles. Once the correct positioning has been obtained, the piles are grouted together with the jacket legs.

In summary, a method of installing an offshore foundation and a template for installing an offshore foundation are provided. In illustrative embodiments, the template is releasably anchored in a seafloor and the template is leveled before installing a pile. In a method according to some illustrative embodiments herein, a template may be provided, the template comprising at least one hollow guiding element for receiving the pile, at least one suction bucket, a frame body to which the at least one hollow guiding element and the at least one suction bucket are coupled, and controlling means configured to supply a pressure to the at least one suction bucket. The method may comprise disposing the template on the seafloor, supplying a negative pressure to the at least one suction bucket for driving the suction bucket in to the seafloor, and controlling the negative pressure supplied to the at least one suction bucket to adjusting a penetration depth of the at least one suction bucket so as to level the frame relative to the seafloor.

The described method is in particular useful for installing a plurality of foundations for offshore wind turbines. Offshore wind turbines are put up in parks of most often at least 10 turbines in order to make full use of required cables to onshore. With the present invention, one template may be used for installing several foundations for turbines. In further embodiments, the template may be equipped with motors, propellers, and a GPS system in order to, by itself, move around under the water surface and make a plurality of piling foundations without external assistance/control. In such embodiments, a number of propellers and/or multi-rotational propellers would be required to be able to navigate in three dimensions under the sea surface. In some embodiments the movement of the template may be controlled from a distance and in other embodiments, the movement may occur due to a set program, whereby the template moves more or less autonomously.

The term 'pile' as used herein is intended to mean any elongated upright element useful for foundations as understood by a skilled person in the art. Typically prefabricated piles are driven into the sea floor using a pile driver or by suction.

The invention claimed is:

1. A method of installing a foundation for an offshore wind turbine, the method comprising:

providing a temporary template with at least one hollow guiding element configured to receiving a pile, at least one suction bucket and a frame body, wherein the frame body comprises a plurality of beams, wherein the at least one suction bucket has cross beams extending to two of the plurality of beams and to the at least one hollow guiding element;

disposing the temporary template on the sea floor;

supplying a negative pressure to the at least one suction bucket for driving the suction bucket into the sea floor, thereby releasably anchoring the temporary template in the sea floor;

controlling the negative pressure supplied to the at least one suction bucket for adjusting a penetration depth of the at least one suction bucket so as to level the frame body relative to the sea floor;

disposing said at least one pile in the hollow guiding element;

driving said at least one pile into the sea floor guided by said hollow guiding element;

releasing the negative pressure to the at least one suction bucket; and removing the temporary template from the sea floor while said at least one pile remains in the sea floor.

2. The method of claim 1, further comprising determining an inclination of the frame body relative to a predetermined reference level of the frame body and adjusting the negative pressure supplied to at least one suction bucket.

3. The method of claim 2, further comprising determining the penetration depth for the at least one suction bucket based on the determined inclination of the frame body so as to level the frame body.

4. The method of claim 3, further comprising controlling the negative pressure in dependence on the determined penetration depth.

5. The method of claim 1, wherein controlling the negative pressure comprises successively sensing an inclination of the frame body and adjusting the negative pressure supplied to the at least one suction bucket in dependence on the sensed inclination.

6. The method of claim 1, further comprising determining an actual penetration depth of at least one suction bucket during supplying the negative pressure and controlling the negative pressure in dependence on the actual penetration depth.

7. The method of claim 1, wherein a plurality of suction buckets is provided and the method further comprises coupling each suction bucket to an individual pump system.

8. The method of claim 1, wherein a plurality of suction buckets is provided and the method further comprises coupling the plurality of suction buckets to a pump system having a single pump.

9. The method of claim 8, wherein the pump system is configured to supply negative pressure to each suction bucket individually.

10. The method of claim 9, wherein controlling the negative pressure comprises controlling a valve element of each suction bucket so as to control the negative pressure supplied to each suction bucket individually, wherein the pump is coupled to the valve elements.

11. The method of claim 1, wherein controlling the negative pressure comprises controlling at least one of an amount and flow of water being pumped out of the at least one suction bucket.

12. The method of claim 1, further comprising:

upon driving said at least one pile into the sea floor, supplying a positive pressure to the at least one suction bucket, thereby releasing the suction bucket, and thereby the template, from the sea floor.

13. The method of claim 12, wherein said positive pressure is obtained through pumping water into the suction bucket.

14. The method of claim 12, wherein said positive pressure is obtained through supplying pressurized air to the suction bucket.

15. The method of claim 12, wherein said releasing of the suction bucket is further supported by additionally applying a lifting force to the suction bucket and/or the template.

16. The method of claim 12, wherein a pulsed supply of positive pressure is provided for facilitating a release of the template.

17. The method of claim 1, wherein at least three piles are driven through individual hollow guiding elements of said template and into the sea floor.

18. The method of claim 1, wherein upon releasably anchoring said template to the sea floor, driving said at least one pile into the sea floor, and releasing said template, said template is transferred to a second location in order to install at least one other foundation for an offshore wind turbine.

19. A method of installing a plurality of foundations for offshore wind turbines, wherein said method comprises individual installations of foundations according to claim 1, wherein said template is transferred between and used for at least separate two foundations.

20. The method of claim 1, further comprising:

installing and anchoring a jacket foundation by coupling the jacket foundation with said piles in the sea floor.

21. The method of claim 1, wherein the at least one suction bucket and the at least one hollow guiding element have respective positions fixed relative to each other.

22. A temporary template for use in installing a foundation in a sea floor for an offshore wind turbine, comprising:

at least one hollow guiding element for receiving a pile;

at least one suction bucket;

a frame body to which the at least one hollow guiding element and the at least one suction bucket are coupled; and controlling means configured to supply a pressure to the at least one suction bucket to temporarily secure the template to the sea floor;

wherein the template is configured to be removed from the sea floor and form no part of the foundation that supports the offshore wind turbine, and the frame body comprises a plurality of beams, wherein the at least one suction bucket has cross beams extending to two of the plurality of beams and to the at least one hollow guiding element.

23. The template of claim 22, wherein the frame body is formed by frame elements being coupled together such that the frame body is of a polygonal shape.

24. The template of claim 23, comprising at least three suction buckets and at least three hollow guiding elements, each of which being mechanically coupled to at least one frame element.

25. The template of claim 23, wherein the frame elements are formed by two parallel beams having crossbeam elements for reinforcing each frame element.

26. The template of claim 22, wherein said suction bucket is provided by a cylindrical bucket with an opening at one side having a top element fixed to a top side of the suction bucket.

27. The template of claim 26, wherein said top element comprises a valve element for coupling the suction bucket to a hose of a pump system.

28. The template of claim 22, wherein said hollow guiding element has a cylindrical sleeve element and outwardly projecting flange portions at respective sides of the cylindrical sleeve element for facilitating receipt of a pile.

29. The temporary template of claim 22, wherein the at least one suction bucket and the at least one hollow guiding element have respective positions fixed relative to each other.

* * * * *